US011674105B2

(12) United States Patent
Nguyen et al.

(10) Patent No.: US 11,674,105 B2
(45) Date of Patent: *Jun. 13, 2023

(54) AZOLE DERIVATIVES AS LUBRICATING ADDITIVES

(71) Applicant: The Lubrizol Corporation, Wickliffe, OH (US)

(72) Inventors: Nga H. Nguyen, Scotch Plains, NJ (US); Peter Miatt, Allestree (GB)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/753,073

(22) PCT Filed: Aug. 17, 2016

(86) PCT No.: PCT/US2016/047247

§ 371 (c)(1),
(2) Date: Feb. 15, 2018

(87) PCT Pub. No.: WO2017/031145

PCT Pub. Date: Feb. 23, 2017

(65) Prior Publication Data

US 2018/0237717 A1 Aug. 23, 2018

Related U.S. Application Data

(60) Provisional application No. 62/207,412, filed on Aug. 20, 2015.

(51) Int. Cl.

| | |
|---|---|
| ***C10M 141/00*** | (2006.01) |
| ***C10M 133/44*** | (2006.01) |
| ***C10M 141/08*** | (2006.01) |
| ***C10M 141/10*** | (2006.01) |
| ***C10M 141/12*** | (2006.01) |
| ***C10M 159/12*** | (2006.01) |
| ***C10M 141/02*** | (2006.01) |
| ***C10M 141/06*** | (2006.01) |
| ***C10M 125/26*** | (2006.01) |
| ***C10M 133/46*** | (2006.01) |

(Continued)

(52) U.S. Cl.

CPC ..... *C10M 133/44* (2013.01); *C10M 125/26* (2013.01); *C10M 133/46* (2013.01); *C10M 141/02* (2013.01); *C10M 141/06* (2013.01); *C10M 141/08* (2013.01); *C10M 141/10* (2013.01); *C10M 141/12* (2013.01); *C10M 159/12* (2013.01); *C10M 2201/087* (2013.01); *C10M 2203/1025* (2013.01); *C10M 2207/026* (2013.01); *C10M 2207/28* (2013.01); *C10M 2215/064* (2013.01); *C10M 2215/223* (2013.01); *C10M 2215/224* (2013.01); *C10M 2215/24* (2013.01); *C10M 2215/28* (2013.01); *C10M 2219/022* (2013.01); *C10M 2219/046* (2013.01); *C10M 2219/106* (2013.01); *C10M 2223/045* (2013.01); *C10M 2227/061* (2013.01); *C10N 2030/04* (2013.01); *C10N 2030/06* (2013.01); *C10N 2030/12* (2013.01); *C10N 2030/36* (2020.05); *C10N 2030/42* (2020.05); *C10N 2030/43* (2020.05); *C10N 2040/044* (2020.05); *C10N 2040/25* (2013.01)

(58) Field of Classification Search

CPC ..... C10M 133/44; C10M 133/46; C10M 125/26; C10M 141/02; C10M 141/06; C10M 141/08; C10M 141/10; C10M 141/12; C10M 2201/087; C10M 2219/106; C10M 2207/28; C10M 2215/24; C10M 2203/1025; C10M 2227/061; C10M 2223/045; C10M 2215/28; C10M 2207/026; C10M 2215/224; C10M 2215/223; C10M 2215/064; C10M 2219/046; C10M 2219/022; C10N 2240/044; C10N 2230/06; C10N 2240/10; C10N 2230/43; C10N 2230/42; C10N 2230/36; C10N 2230/12; C10N 2230/04

See application file for complete search history.

(56) References Cited

U.S. PATENT DOCUMENTS 3,791,803 A 2/1974 Andress, Jr. et al.
4,095,025 A 6/1978 Newberry (Continued)

FOREIGN PATENT DOCUMENTS

WO WO-2013123160 A1 * 8/2013 ..... C10M 169/041

OTHER PUBLICATIONS

European Patent Office, Written Opinion of the International Searching Authority, dated Oct. 26, 2016 for International Patent Application No. PCT/US16/047247.

(Continued)

*Primary Examiner* — Taiwo Oladapo

(74) *Attorney, Agent, or Firm* — Iken Sans; Michael Miller

(57) ABSTRACT

Lubricating compositions comprising an azole-acrylic adduct formed by contacting an azole compound with an acrylic. The adduct formed has at least one N-alkyl group comprising at least one acyl. The lubricating composition also comprises a thiadiazole. Methods of lubricating a component of a farm tractor, off-highway vehicle or drive-train comprising contacting the component with the lubricating composition comprising an azole-acrylic adduct formed by mixing an azole compound with an acrylic. Methods of reducing corrosion in a component. The use of an azole-acrylic adduct in a lubricating composition to reduce corrosion in a component.

9 Claims, No Drawings

(51) Int. Cl.

| | |
|---|---|
| *C10N 30/04* | (2006.01) |
| *C10N 30/06* | (2006.01) |
| *C10N 30/12* | (2006.01) |
| *C10N 30/00* | (2006.01) |
| *C10N 40/25* | (2006.01) |
| *C10N 40/04* | (2006.01) |

(56) References Cited

U.S. PATENT DOCUMENTS

| | | | | |
|---|---|---|---|---|
| 4,184,991 | A | 1/1980 | Scheurman, III | |
| 4,202,783 | A * | 5/1980 | Chibnik | C07D 249/18 252/403 |
| 5,492,544 | A | 2/1996 | Farng et al. | |
| 5,507,963 | A | 4/1996 | Wolf | |
| 5,714,442 | A | 2/1998 | Wolf | |
| 8,530,397 | B2 | 9/2013 | Bera et al. | |
| 2006/0240998 | A1 | 10/2006 | Sullivan | |
| 2010/0105585 | A1 * | 4/2010 | Carey | C10M 141/10 508/162 |
| 2014/0187455 | A1 | 7/2014 | Umehara et al. | |

OTHER PUBLICATIONS

European Patent Office, International Search Report, dated Oct. 26, 2016 for International Patent Application No. PCT/US16/047247.
Brazilian Preliminary Office Action, notice published in the Official Bulletin n° 2,568, dated Mar. 24, 2020.
Jian Zhang et al., "Modem Lubrication Technique", Metallurgical Industry Press, Jan. 31, 2008, p. 67.

* cited by examiner

AZOLE DERIVATIVES AS LUBRICATING ADDITIVES

CROSS REFERENCE TO RELATED APPLICATION

This application claims priority from PCT Application Serial No. PCT/US2016/047247 filed on Aug. 17, 2016, which claims the benefit of U.S. Provisional Application No. 62/207,412 filed on Aug. 20, 2015, both of which are incorporated in their entirety by reference herein.

FIELD OF THE INVENTION

The field of the disclosed technology is generally related to lubricating compositions comprising azole derivatives.

BACKGROUND OF THE INVENTION

Lubricants for driveline power transmitting devices (such as gears or transmissions), especially axle fluids, automatic transmission fluids (ATFs), and manual transmission fluids (MTFs)), present highly challenging technological problems and solutions for satisfying the multiple and often conflicting lubricating requirements, whilst providing durability and cleanliness. Lubricating compositions generally have antiwear and extreme pressure additives to provide driveline power transmitting devices with prolonged life and efficiency. Lubricating compositions should also reduce deposit formation and corrosion and provide oxidation stability. Unfortunately, many of the antiwear or extreme pressure additives employed have limited oxidative stability, form deposits, or increase corrosion. In addition, many phosphorus antiwear or extreme pressure additives typically contain sulfur, which results in an odorous lubricating composition containing the phosphorus antiwear or extreme pressure additives.

In addition, many lubricants contain zinc dialkyldithiophosphate (ZDDP) antiwear agents. In the presence of water, the ZDDP may break down, resulting in release of more labile (or reactive) sulfur. The labile sulfur may increase copper corrosion. Additionally, as the ZDDP antiwear agent decomposes increased wear may occur due to the presence of reduced amounts of antiwear agent.

It is difficult for formulators to meet the present driveline lubricant specifications by employing certain beneficial additives while also meeting the specification for lead or copper corrosion. Commonly used copper corrosion inhibitors include azoles or their derivatives, such as methyl benzyl triazole (often referred to as tolyltriazole or simply, "TTZL"). Both TTZL and TTZL derivatives may have disadvantages in certain applications. TTZL is a solid that melts at 80° C., making it difficult to blend or suspend in the lubricating oil manufacturing process. TTZL may also contribute to lead corrosion under some circumstances. Thus, TTZL and its known derivatives have not sufficiently addressed the corrosion inhibition needs in lubricating oils. Additional copper corrosion inhibitors include thiadiazoles and substituted thiadiazoles such as 1,3,4-thiadiazole,2,5-bis(tert-nonyldithio) or 2-(heptyl hydroxyphenylmethylthio)-5-mercapto-[1,3,4]-thiadiazole. Thiadiazoles, however, can release t-nonyl mercaptan, resulting in an unpleasant odor.

SUMMARY OF THE INVENTION

It was surprisingly found, however, that azole derivatives made with acrylics inhibit copper corrosion with minimal detriment to lead corrosion. Further, azole derivatives, when used with a thiadiazole, provide a synergistic effect to inhibit copper corrosion, thereby allowing the amount to odorous thiadiazoles to be reduced while maintaining corrosion inhibiting performance. The azole derivatives are oil-soluble liquids at room temperature, making them easier to blend or suspend in lubricating oils than their TTZL or TTZL derivative precursors. Accordingly, in one embodiment, lubricating compositions comprising a thiadiazole and an azole-acrylic adduct formed by contacting an azole compound with an acrylic are disclosed. The adduct formed has at least one nitrogen-alkyl (or "N-alkyl") group comprising at least one acyl.

The acrylic may comprise at least one (meth)acrylate, (meth)acrylic acid, (meth)acrylamide, or combinations thereof. As used herein, the term "acrylic" includes derivatives of acrylic or methacrylic acids, salts, or amides. Further, the term "(meth)acrylate" and related terms includes both acrylate and methacrylate groups, ie. the methyl group is optional. Accordingly, in some embodiments, the acrylic may comprise at least one acrylate, acrylic acid, acrylamide, methacrylate, methacrylic acid, methacrylamide, or combinations thereof. In yet other embodiments, the acrylic may be a (meth)acrylate having the formula (I):

(I)

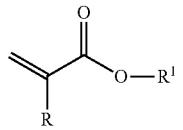

wherein R is a hydrogen or a $C_1$-$C_{20}$ hydrocarbyl group and $R^1$ is a $C_1$-$C_{20}$ hydrocarbyl group. In another embodiment, R may be a hydrogen or a methyl group.

In yet other embodiments, the (meth)acrylate may comprise at least one acrylate, methacrylate, or combinations thereof.

Suitable acrylates include, but are not limited to, octadecyl acrylate, hexadecyl acrylate, tridecyl acrylate, dodecyl acrylate, decyl acrylate, 2-propylheptyl acrylate, 2-ethylhexyl acrylate, octyl acrylate, hexyl acrylate, butyl acrylate, ethyl acrylate, methyl acrylate, or combinations thereof. Suitable methacrylates include, but are not limited to, octadecyl methacrylate, hexadecyl methacrylate, tridecyl methacrylate, dodecyl methacrylate, decyl methacrylate, 2-propylheptyl methacrylate, 2-ethylhexyl methacrylate, octyl acrylate, hexyl methacrylate, butyl methacrylate, ethyl methacrylate, methyl methacrylate, or combinations thereof.

Suitable azole compounds for making the azole-acrylic adducts include, but are not limited to, benzotriazole, benzotriazole derivatives, imidazole, imidazole derivatives, 1,2,3-triazole, 1,2,3-triazole derivatives, 1,2,4-triazole, 1,2,4-triazole derivatives, 1,3,4-triazole, 1,3,4-triazole derivatives, benzimidazole, benzimidazole derivatives, pyrazole, pyrazole derivatives, 1,4, methyl benzotriazole, or combinations thereof.

In one embodiment, the lubricating composition may comprise an azole-acrylic adduct represented by formula (II) or (III):

(II)

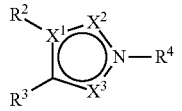

or

-continued (III)

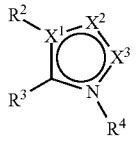

wherein $R^2$ and $R^3$, are independently a hydrogen or a $C_1$-$C_{20}$ hydrocarbyl group or, when taken together, $R^2$ and $R^3$ form a saturated or unsaturated ring containing 5 to 6 carbon atoms; $R^4$ is a $C_2$-$C_{40}$ hydrocarbyl group comprising at least one acyl, wherein the hydrocarbyl group is linear, branched, homocyclic, or heterocyclic, or a combination thereof; $X^1$ is N or C; and $X^2$ and $X^3$ are independently N, or C—$R^5$, wherein $R^5$ is a hydrogen or a $C_1$-$C_{12}$ hydrocarbyl group.

In another embodiment, the azole-acrylic adduct may have the formula above wherein at least two of $X^1$, $X^2$, and $X^3$ are N. In another embodiment, at least one of $X^1$, $X^2$, and $X^3$ is C. In yet another embodiment, $X^2$ and $X^3$ are both N.

In another embodiment, the azole-acrylic adduct may have the formula (VI):

(VI)

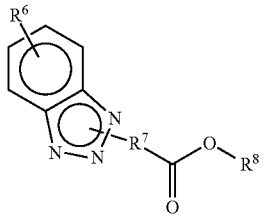

wherein $R^6$ is hydrogen or a $C_1$-$C_{20}$ hydrocarbyl group; $R^7$ is attached to a nitrogen atom and is a linear $C_2$-$C_{20}$ hydrocarbyl group; and $R^8$ is a $C_1$-$C_{20}$ hydrocarbyl group and is linear, branched, homocyclic, heterocyclic, or a combination thereof.

The azole-acrylic adducts can be at least one of formula (VII), (VIII), (IX), (X), (XI), or (XII):

(VII)

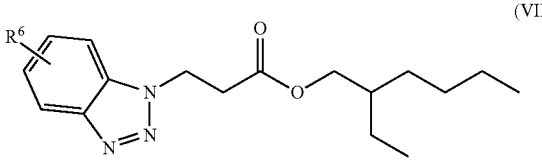

(VIII)

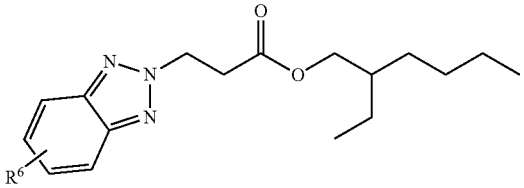

(IX)

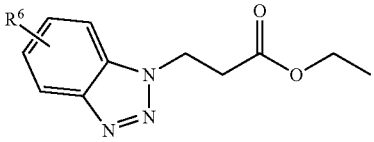

-continued (X)

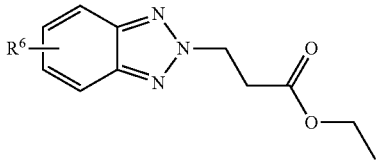

(XI)

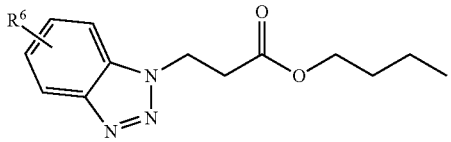

(XII)

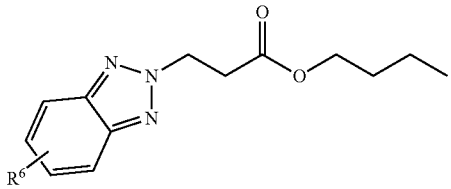

wherein $R^6$ is hydrogen or a $C_1$-$C_{20}$ hydrocarbyl group.

The lubricating composition may comprise from 0.01 wt % to 2 wt % of said azole-acrylic adduct based on a total weight of said lubricating composition.

In other embodiments, the lubricating composition may comprise from 0.01 wt % to 1 wt % thiadiazole, based on a total weight of the lubricating composition. In other embodiment, the thiadiazole may range from 0.05 wt % to 0.5 wt %. Alternatively, the thiadiazole may be present at about 0.3 wt %, based on a total weight of the lubricating composition. The thiadiazole may comprise 1,3,4-thiadiazole,2,5-bis(tert-nonyldithio), 2-(heptyl hydroxyphenylmethylthio)-5-mercapto-[1,3,4]-thiadiazole, or mixtures thereof.

In some embodiments, the aggregate amount of thiadiazole and azole-acrylic adduct ranges from greater than 0.01 to less than 3 wt %, based on a total weight of the lubricating composition. In other embodiments, the total aggregate amount may be greater than 0.05 to less than 2, or even greater than 0.1 to less than 1 or 0.75 wt %, based on a total weight of the lubricating composition.

In yet another embodiment, the lubricating composition may further comprise at least one friction modifier.

In one embodiment, the lubricating composition may have an antiwear agent. In one embodiment, the antiwear agent may be present in an amount such that the lubricating composition has at least about 300 ppm phosphorus based on a total weight of the lubricating composition.

Methods of lubricating components of a farm tractor, off-highway vehicle or drivetrain are also disclosed. The method may comprise contacting the component with any of the lubricating compositions described above.

The azole-acrylic adduct as described above may be used in lubricating compositions to reduce corrosion in a component of a farm tractor, off-highway vehicle or drivetrain. Methods reducing corrosion in a component of a farm tractor, off-highway vehicle or drivetrain are also disclosed. The methods may comprise contacting the component with the lubricating compositions comprising an azole-acrylic adduct as described above.

In one embodiment, the component is a drivetrain component comprising at least one of a transmission, manual transmission, gear, gearbox, axle gear, automatic transmission, a dual clutch transmission, or combinations thereof. In another embodiment, the transmission may be an automatic transmission or a dual clutch transmission. Alternatively, the transmission may be a manual transmission or gear. In yet another embodiment, the component may be a farm tractor or off-highway vehicle component comprising at least one of a wet-brake, a transmission, a hydraulic, a final drive, a power take-off system, or combinations thereof.

DETAILED DESCRIPTION OF THE INVENTION

The present technology provides lubricating compositions and methods for lubricating a farm tractor, off-highway vehicle, or drivetrain component as disclosed above. Typically the component is a driveline component (including a gear or transmission). The lubricating compositions may also be multi-application lubricants used to lubricate the moving parts of off-highway mobile equipment such as farm tractors, off-highway equipment, and construction equipment. These multi-application lubricants are designed to lubricate the transmissions, differentials, final-drive planetary gears, wet-brakes, and hydraulic systems of said equipment. Therefore these fluids must meet many performance requirements including water tolerance, copper corrosion resistance, wet-brake friction, wear resistance, and high energy clutch transmission performance. Lubricants such as tractor lubricants are often exposed to large contaminant amounts of water. The contaminant amounts of water are believed to be caused by ingress of water through equipment seals during operation. The water may form a second layer in the lubricant. Typically, to reduce the formation of the second layer, emulsifiers are employed. If the water is not emulsified into the lubricant, the water may cause additional difficulties such as copper corrosion from copper containing parts of a wet-brake, a transmission, a hydraulic, a final drive, a power take-off system. These parts are typically lubricated by a single lubricant supplied from a common sump.

Each of the documents referred to herein is incorporated by reference, including any prior applications, whether or not specifically listed herein, from which priority is claimed. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention can be used together with ranges or amounts for any of the other elements.

As used herein, the transitional term "comprising," which is synonymous with "including," "containing," or "characterized by," is inclusive or open-ended and does not exclude additional, un-recited elements or method steps. However, in each recitation of "comprising" herein, it is intended that the term also encompass, as alternative embodiments, the phrases "consisting essentially of" and "consisting of," where "consisting of" excludes any element or step not specified and "consisting essentially of" permits the inclusion of additional un-recited elements or steps that do not materially affect the basic and novel characteristics of the composition or method under consideration.

Various features and embodiments will be described below by way of non-limiting descriptions and examples. In one embodiment, lubricating compositions comprising an azole-acrylic adduct formed by reacting an azole compound with an acrylic are disclosed. The adduct formed has at least one nitrogen-alkyl (or "N-alkyl") group comprising at least one acyl. The lubricating composition also comprises an antiwear agent and an antioxidant. As used herein reference to the amounts of components or additives present in the lubricating composition disclosed herein are quoted on an oil free basis, i.e., amount of actives.

The acrylic may comprise at least one (meth)acrylate, (meth)acrylic acid, (meth)acrylamide, or combinations thereof. In one embodiment, the acrylic may be a (meth) acrylate having the formula (I):

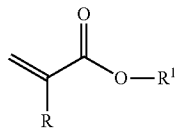

(I)

wherein R is a hydrogen or a $C_1$-$C_{20}$ hydrocarbyl group and $R^1$ is a $C_1$-$C_{20}$ hydrocarbyl group. In another embodiment, R may be a hydrogen or a methyl group.

As used herein, the terms "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. The hydrocarbyl substituent or hydrocarbyl group may have more than one carbon atom. The number of carbon atoms may also be indicated herein. For example, the term "$C_1$-$C_{20}$ hydrocarbyl group" means a hydrocarbyl group having 1 to 20 carbon atoms. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of the disclosed technology, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of the disclosed technology, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, or no more than one, non-hydrocarbon substituent will be present for every ten carbon atoms in the hydrocarbyl group; alternatively, there may be no non-hydrocarbon substituents in the hydrocarbyl group.

In other embodiments, the acrylic may comprise an acrylic acid having the formula (III):

(III)

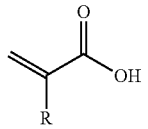

wherein R is a hydrogen or a $C_1$-$C_{20}$ hydrocarbyl group.

In yet other embodiments, the acrylic may comprise an acrylamide having the formula (IV):

(IV)

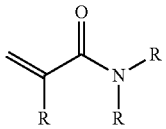

wherein each R may independently be a hydrogen or a $C_1$-$C_{20}$ hydrocarbyl group.

In one embodiment, the acrylate may comprise at least one acrylate, (meth)acrylate, (butyl)acrylate, or combinations thereof. In one embodiment, the acrylate may comprise at least one acrylate, (meth)acrylate, or combinations thereof. In another embodiment, the acrylic may comprise at least one methacrylate, methacrylic acid, methacrylamide, or combinations thereof.

Suitable acrylates include, but are not limited to, octadecyl acrylate, hexadecyl acrylate, tridecyl acrylate, dodecyl acrylate, decyl acrylate, 2-propylheptyl acrylate, 2-ethylhexyl acrylate, octyl acrylate, hexyl acrylate, butyl acrylate, ethyl acrylate, methyl acrylate, or combinations thereof. Suitable methacrylates include, but are not limited to, octadecyl methacrylate, hexadecyl methacrylate, tridecyl methacrylate, dodecyl methacrylate, decyl methacrylate, 2-propylheptyl methacrylate, 2-ethylhexyl methacrylate, octyl acrylate, hexyl methacrylate, butyl methacrylate, ethyl methacrylate, methyl methacrylate, or combinations thereof.

The azole compound may be a substituted or unsubstituted heterocyclic azole. In one embodiment, the substituted heterocyclic azole may have the structure as in formula (V):

(V)

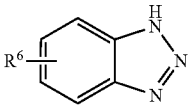

wherein $R^6$ is a hydrogen or a $C_1$-$C_{16}$ hydrocarbyl group.

Suitable azole compounds for making the azole-acrylic adducts include, but are not limited to, benzotriazole, benzotriazole derivatives, imidazole, imidazole derivatives, 1,2,3-triazole, 1,2,3-triazole derivatives, 1,2,4-triazole, 1,2,4-triazole derivatives, 1,3,4-triazole, 1,3,4-triazole derivatives, benzimidazole, benzimidazole derivatives, pyrazole, pyrazole derivatives, 1,4, methyl benzotriazole, or combinations thereof. The reaction of the azole compound with an acrylic may take place in the presence of trimethylamine or acetonitrile as catalyst or solvent.

In one embodiment, the lubricating composition may comprise an azole-acrylic adduct represented by formula (II) or (III):

(II)

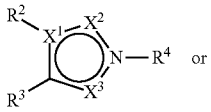

or (III)

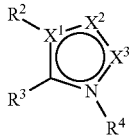

wherein $R^2$ and $R^3$ are independently a hydrogen or $C_1$-$C_{20}$ hydrocarbyl group or, when taken together, $R^2$ and $R^3$ form a saturated or unsaturated ring containing 5 to 6 carbon atoms; $R^4$ is a $C_2$-$C_{40}$ hydrocarbyl group and comprises at least one acyl, wherein the hydrocarbyl group is linear, branched, homocyclic, or heterocyclic, or a combination thereof; $X^1$ is N or C; and $X^2$ and $X^3$ are independently N, or C—$R^5$, wherein $R^5$ is a hydrogen or $C_1$-$C_{12}$ hydrocarbyl group.

In another embodiment, the azole-acrylic adduct may have the formula (II) or (III) above wherein at least one, or alternatively, at least two of $X^1$, $X^2$, and $X^3$ are N. In another embodiment, at least one of $X^1$, $X^2$, and $X^3$ is C. In yet another embodiment, $X^2$ and $X^3$ are both N. In other embodiments, $X^1$, $X^2$, and $X^3$ may all be N, or alternatively, they may all be C.

In another embodiment, the azole-acrylic adduct may have the formula (VI):

(VI)

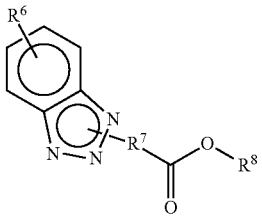

wherein $R^6$ is hydrogen or a $C_1$-$C_{20}$ hydrocarbyl group; IC is attached to a nitrogen atom and is a linear $C_2$-$C_{20}$ hydrocarbyl group; and $R^8$ is a $C_1$-$C_{20}$ hydrocarbyl group and is linear, branched, homocyclic, heterocyclic, or a combination thereof. In one embodiment, $R^7$ is a linear $C_2$ hydrocarbyl group.

Exemplary azole-acrylic adducts include, but are not limited to, the reaction products of benzotriazole and 2-ethylhexyl acrylate, imidazole and 2-ethylhexyl acrylate, 1,2,4-triazole and 2-ethylhexyl acrylate, benzimidazole and 2-ethylhexyl acrylate, pyrazole and 2-ethylhexyl acrylate, tolyltriazole and butyl acrylate, and tolyltriazole, and ethyl acrylate.

Exemplary azole-acrylic adducts include adducts and isomers made from 2-ethylhexyl acrylate and ethyl acrylate. These adducts include, but are not limited, to 2-ethylhexyl 3-(5-methyl-1H-benzo[d][1,2,3]triazol-1yl)propanoate (from 2-ethylhexyl acrylate), and ethyl 3-(5-methyl-1H-benzo[d][1,2,3]triazol-1yl)propanoate (from ethyl acrylate).

In one embodiment, the azole-acrylic adducts can have formula (VII), (VIII), (IX), (X), (XI), or (XII):

(VII)

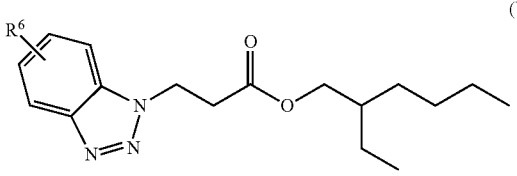

(VIII)

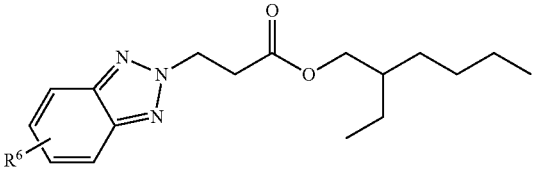

(IX)

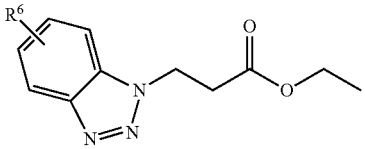

-continued (X)

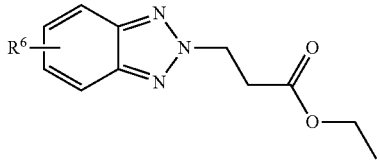

(XI)

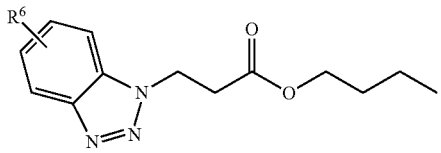

(XII)

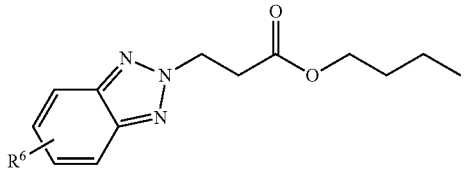

wherein $R^6$ is hydrogen or a $C_1$-$C_{20}$ hydrocarbyl group.

Further azole-acrylic adducts include the isomers listed in Table 1 below.

TABLE 1

| Acrylate Reactant | Isomer 1 | Isomer 2 |
|---|---|---|
| methyl acrylate | 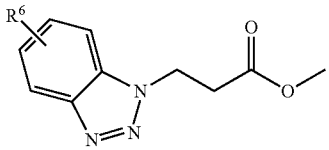 | 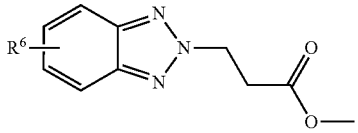 |
| butyl acrylate | 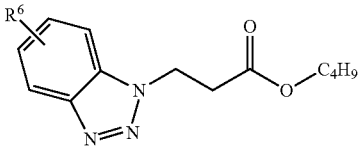 | 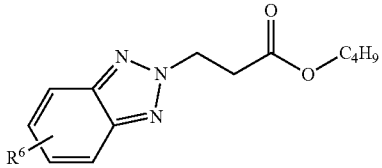 |
| hexyl acrylate | 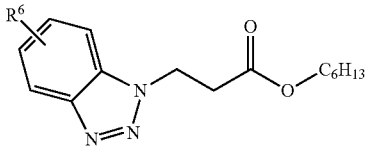 | 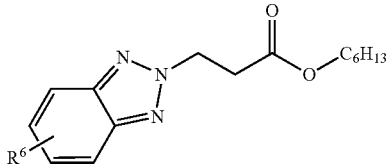 |
| octyl acrylate | 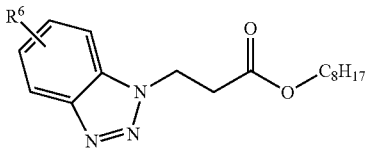 | 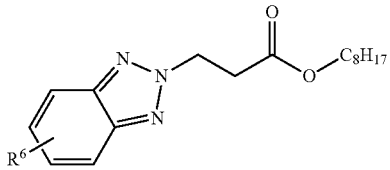 |
| 2-propyl heptyl acrylate | 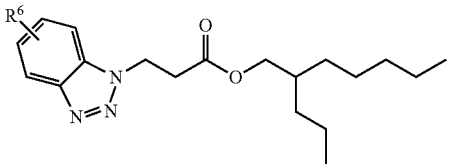 | 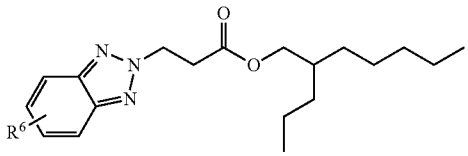 |

TABLE 1-continued

| Acrylate Reactant | Isomer 1 | Isomer 2 |
|---|---|---|
| decyl acrylate | 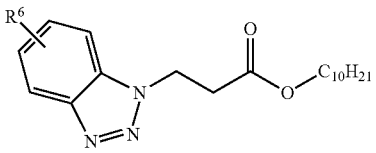 | 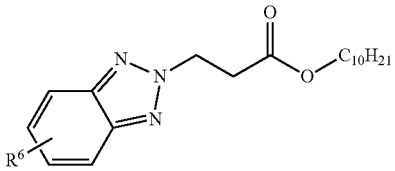 |
| do-decyl acrylate | 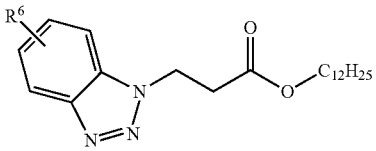 | 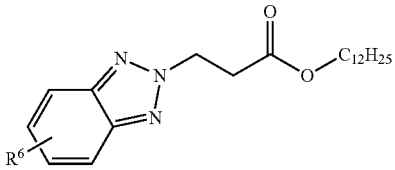 |
| Tri-decyl acrylate | 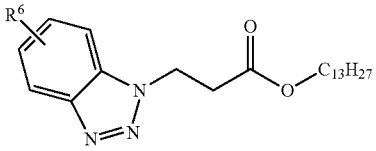 | 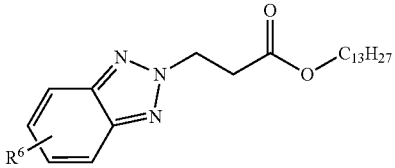 |
| hexa-decyl acrylate | 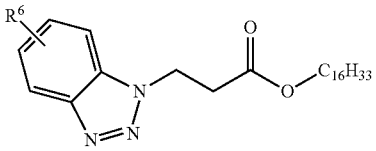 | 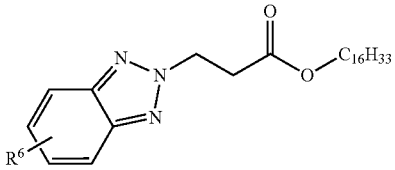 |
| octa-decyl acrylate | 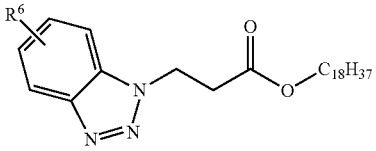 | 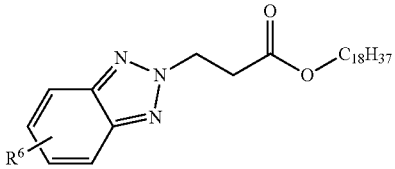 |

*$R^6$ is hydrogen or a $C_1$—$C_{20}$ hydrocarbyl group.

The lubricating compositions may comprise from 0.01 wt % to 2 wt % of an azole-acrylic adduct based on a total weight of the lubricating composition.

When used with a thiadiazole, the azole-acrylic adducts can provide an unexpected synergistic effect in reducing or preventing corrosion. Accordingly, in one embodiment, the lubricating compositions may comprise both the azole-acrylic adduct described above and a thiadiazole.

Thiadiazole Compounds

The lubricating composition may comprise from 0.01 wt % to 1 wt % thiadiazole, based on a total weight of the lubricating composition. In other embodiments, the thiadiazole may range from 0.05 wt % to 0.5 wt %. Alternatively, the thiadiazole may be present at about 0.3 wt %, based on a total weight of the lubricating composition.

The thiadiazole may be a thiadiazole or a hydrocarbyl-substituted thiadiazole. Examples of a thiadiazole include 2,5-dimercapto-1,3,4-thiadiazole, or oligomers thereof, a hydrocarbyl-substituted 2,5-dimercapto-1,3-4-thiadiazole, a hydrocarbylthio-substituted 2,5-dimercapto-1,3-4-thiadiazole, or oligomers thereof. The oligomers of hydrocarbyl-substituted 2,5-dimercapto-1,3-4-thiadiazole typically form by forming a sulfur-sulfur bond between 2,5-dimercapto-1,3-4-thiadiazole units to form oligomers of two or more of said thiadiazole units.

Additional examples of a suitable thiadiazole compound include at least one of a dimercaptothiadiazole, 2,5-dimercapto-[1,3,4]-thiadiazole, 3,5-dimercapto-[1,2,4]-thiadiazole, 3,4-dimercapto-[1,2,5]-thiadiazole, or 4-5-dimercapto-[1,2,3]-thiadaizole. Typically readily available materials such as 2,5-dimercapto-1,3,4-thiadiazole or a hydrocarbyl-substituted 2,5-dimercapto-1,3-4-thiadiazole or a hydrocarbylthio-substituted 2,5-dimercapto-1,3,4-thiadiazole may be commonly utilized, with 2,5-dimercapto-[1,3,4]-thiadiazole most commonly utilized due to availability. In different embodiments the number of carbon atoms on the hydrocarbyl-substituent group includes 1 to 30, 2 to 25, 4 to 20, 6 to 16, or 8 to 10.

In one embodiment, the thiadiazole compound may be the reaction product of a phenol with an aldehyde and a dimercaptothiadiazole. The phenol includes an alkyl phenol wherein the alkyl group contains at least 6, e.g., 6 to 24, or 6 (or 7) to 12 carbon atoms. The aldehyde includes an aldehyde containing 1 to 7 carbon atoms or an aldehyde synthon, such as formaldehyde. Useful thiadiazole compounds include 2-alkyldithio-5-mercapto-[1,3,4]-thiadiazoles, 2,5-bis(alkyldithio)-[1,3,4]-thiadiazoles, 2-alkylhydroxyphenylmethylthio-5-mercapto-[1,3,4]-thiadiazoles (such as 2-[5-heptyl-2-hydroxyphenylmethylthio]-5-mercapto-[1,3,4]-thiadiazole), and mixtures thereof.

In one embodiment the thiadiazole compound includes at least one of 2,5-bis(tert-octyldithio)-1,3,4-thiadiazol e, 2,5-bis(tert-nonyldithio)-1,3,4-thiadiazole, or 2,5-bis(tert-decyldithio)-1,3,4-thiadiazole. In yet another embodiment, the thiadiazole comprises at least one of 1,3,4-thiadiazole,2,5-bis(tert-nonyldithio), 2-(heptyl hydroxyphenylmethylthio)-5-mercapto-[1,3,4]-thiadiazole, or mixtures thereof.

Friction Modifier

In one embodiment the lubricating composition may further comprise a friction modifier. In different embodiments, the friction modifier may be present at 0 wt % to 5 wt %, or 0.1 wt % to 4 wt %, or 0.25 wt % to 3.5 wt %, or 0.5 wt % to 2.5 wt %, or 1 wt % to 2.5 wt %, or 0.05 wt % to 0.5 wt % of the lubricating composition.

The friction modifier includes fatty amines, borated glycerol esters, fatty acid amides, non-borated fatty epoxides, borated fatty epoxides, alkoxylated fatty amines, borated alkoxylated fatty amines, metal salts of fatty acids, fatty imidazolines, metal salts of alkyl salicylates (may also be referred to as a detergent), metal salts of sulphonates (may also be referred to as a detergent), condensation products of carboxylic acids or polyalkylene-polyamines, or amides of hydroxyalkyl compounds.

In one embodiment the friction modifier is another type of fatty acid derivative. In one embodiment the friction modifier includes a fatty acid ester or partial ester of glycerol. Such a friction modifier may be in the form of a metal salt, an amide, an imidazoline, or mixtures thereof. The fatty acids may contain 6 to 24, or 8 to 18 carbon atoms. The fatty acids may be branched or straight-chain, saturated or unsaturated. Suitable acids include 2-ethylhexanoic, decanoic, oleic, stearic, isostearic, palmitic, myristic, palmitoleic, linoleic, lauric, and linolenic acids, and the acids from the natural products tallow, palm oil, olive oil, peanut oil, corn oil, and Neat's foot oil. In one embodiment the fatty acid may be oleic acid. When in the form of a metal salt, typically the metal includes zinc or calcium; and the products include overbased and non-overbased products. Examples may be overbased calcium salts and basic oleic acid-zinc salt complexes. When in the form of an amide, the condensation product includes those prepared with ammonia, or with primary or secondary amines such as diethylamine and diethanolamine. When in the form of an imidazoline, the condensation product of an acid with a diamine or polyamine such as a polyethylenepolyamine. In one embodiment the friction modifier may be the condensation product of a fatty acid with $C_8$ to $C_{24}$ atoms, and a polyalkylene polyamine, and in particular, the product of isostearic acid with tetraethylenepentamine.

In one embodiment the friction modifier includes a secondary or tertiary amine being represented by the formula $R^aR^bNR^c$, wherein $R^a$ and $R^b$ are each independently an alkyl group of at least 6 carbon atoms and $R^c$ is hydrogen, a hydrocarbyl group, a hydroxyl-containing alkyl group, or an amine-containing alkyl group. A more detailed description of the friction modifier is described in US Patent Application 2005/037897 in paragraphs 8 and 19 to 22.

In one embodiment the friction modifier includes those formed by the condensation of the hydroxyalkyl compound with an acylating agent or an amine. A more detailed description of the hydroxyalkyl compound is described in U.S. Patent Application 60/725,360 (filed on Oct. 11, 2005, inventors Bartley, Lahiri, Baker and Tipton) in paragraphs 8, and 19-21. The friction modifier disclosed in U.S. Patent Application 60/725,360 includes an amide represented by the formula $R^dR^dN—C(O)R^f$, wherein $R^d$ and $R^e$ are each independently hydrocarbyl groups of at least 6 carbon atoms and $R^f$ is a hydroxyalkyl group of 1 to 6 carbon atoms or a group formed by the condensation of said hydroxyalkyl group, through a hydroxyl group thereof, with an acylating agent. Preparative Examples are disclosed in Examples 1 and 2 (paragraphs 68 and 69 of U.S. Patent Application 60/725,360). In one embodiment the amide of a hydroxylalkyl compound is prepared by reacting glycolic acid, that is, hydroxyacetic acid, $HO—CH_2—COOH$ with an amine.

In one embodiment the friction modifier includes a reaction product of a di-cocoalkyl amine (or di-cocoamine) with glycolic acid. The friction modifier includes compounds prepared in Preparative Examples 1 and 2 of U.S. Patent Application 60/820,516.

In one embodiment the friction modifier includes those derived from the reaction product of a carboxylic acid or a reactive equivalent thereof with an aminoalcohol, wherein the friction modifier contains at least two hydrocarbyl groups, each containing at least 6 carbon atoms. An example of such a friction modifier includes the reaction product of isostearic acid or an alkyl succinic anhydride with tris-hydroxymethylaminomethane. A more detailed description of such a friction modifier is disclosed in US Patent Application 2003/22000 (or International Publication WO04/007652) in paragraphs 8 and 9 to 14.

In one embodiment the friction modifier includes an alkoxylated alcohol. A detailed description of suitable alkoxylated alcohols is described in paragraphs 19 and 20 of US Patent Application 2005/0101497. The alkoxylated amines are also described in U.S. Pat. No. 5,641,732 in column 7, line 15 to column 9, line 25.

In one embodiment the friction modifier includes a hydroxyl amine compound as defined in column 37, line 19, to column 39, line 38 of U.S. Pat. No. 5,534,170. Optionally the hydroxyl amine includes borated as such products are described in column 39, line 39 to column 40 line 8 of U.S. Pat. No. 5,534,170.

In one embodiment the friction modifier includes an alkoxylated amine e.g., an ethoxylated amine derived from 1.8% Ethomeen T-12 and 0.90% Tomah PA-1 as described in Example E of U.S. Pat. No. 5,703,023, column 28, lines 30 to 46. Other suitable alkoxylated amine compounds include commercial alkoxylated fatty amines known by the trademark "ETHOMEEN" and available from Akzo Nobel. Representative examples of these ETHOMEEN™ materials is ETHOMEEN™ C/12 (bis[2-hydroxyethyl]-coco-amine); ETHOMEEN™ C/20 (polyoxyethylene[10]cocoamine); ETHOMEEN™ S/12 (bis[2-hydroxyethyl]-soyamine); ETHOMEEN™ T/12 (bis[2-hydroxyethyl]allow-amine); ETHOMEEN™ T/15 (polyoxyethylene-[5]tallowamine); ETHOMEEN™ 0/12 (bis[2-hydroxyethyl]oleyl-amine); ETHOMEEN™ 18/12 (bis[2-hydroxyethyl]octadecyl amine); and ETHOMEEN™ 18/25 (polyoxyethylene[15] octadecylamine). Fatty amines and ethoxylated fatty amines are also described in U.S. Pat. No. 4,741,848.

In one embodiment the friction modifier includes a polyol ester as described in U.S. Pat. No. 5,750,476 column 8, line 40 to column 9, line 28.

In one embodiment the friction modifier includes a low potency friction modifier as described in U.S. Pat. No. 5,840,662 in column 2, line 28 to column 3, line 26. U.S. Pat. No. 5,840,662 further discloses in column 3, line 48 to column 6, line 25 specific materials and methods of preparing the low potency friction modifier.

In one embodiment the friction modifier includes a reaction product of an isomerised alkenyl substituted succinic anhydride and a polyamine as described in U.S. Pat. No. 5,840,663 in column 2, lines 18 to 43. Specific embodiments of the friction modifier described in U.S. Pat. No. 5,840,663 are further disclosed in column 3, line 23 to column 4, line 35. Preparative examples are further disclosed in column 4, line 45 to column 5, line 37 of U.S. Pat. No. 5,840,663.

In one embodiment the friction modifier includes an alkylphosphonate mono- or di-ester sold commercially by Rhodia under the trademark Duraphos® DMODP.

In one embodiment the friction modifier includes a borated fatty epoxide or alkylene oxide, known from Canadian Patent No. 1,188,704. These oil-soluble boron-containing compositions may be prepared by reacting, at a temperature of 80° C. to 250° C., boric acid or boron trioxide with at least one fatty epoxide or alkylene oxide. The fatty epoxide or alkylene oxide typically contains at least 8 carbon atoms in the fatty groups of the epoxide (or the alkylene groups of the alkylene oxide).

The borated fatty epoxides include those characterized by the method for their preparation which involves the reaction of two materials. Reagent A includes boron trioxide or any of the various forms of boric acid including metaboric acid ($HBO_2$), orthoboric acid ($H_3BO_3$) and tetraboric acid ($H_2B_4O_7$), or orthoboric acid. Reagent B includes at least one fatty epoxide. The molar ratio of reagent A to reagent B may be generally 1:0.25 to 1:4, or 1:1 to 1:3, or 1:2. The borated fatty epoxides includes compounds prepared by blending the two reagents and heating them at temperature of 80° C. to 250° C., or 100° C. to 200° C., for a period of time sufficient for reaction to take place. If desired, the reaction may be effected in the presence of a substantially inert, normally liquid organic diluent. During the reaction, water is evolved and may be removed by distillation.

In one embodiment, the friction modifier may comprise metal salts of fatty acids, fatty imidazolines, metal salts of alkyl salicylates, metal salts of sulfonates, or combinations thereof.

Antiwear Agent

In another embodiment, the lubricating composition may have an antiwear agent. The antiwear agent may be a phosphorus-containing or a sulfur-containing antiwear agent. In one embodiment, the antiwear agent may comprise phosphorous that is present in an amount such that the lubricating composition has 200 to 1500, or 300 to 1300, 350 to 800, or 500 to 1000, ppm phosphorous based on a total weight of the lubricating composition.

Antiwear agents include a non-ionic phosphorus compound with phosphorus atoms having an oxidation state of +3, a metal dialkyldithiophosphate, metal dialkylphosphate (typically a zinc di dialkylphosphate), a metal dialkyldithiophosphate (typically a zinc di dialkyldithiophosphate), or mixtures thereof.

Examples of a suitable zinc dialkyldithiophosphate often referred to as ZDDP, ZDP or ZDTP) include zinc di-(2-methylpropyl) dithiophosphate/di-(amyl) dithiophosphate, zinc di-(1,3-dimethylbutyl) dithiophosphate, zinc di-(heptyl) dithiophosphate, zinc di-(octyl) dithiophosphate, zinc di-(2-ethylhexyl) dithiophosphate, zinc di-(nonyl) dithiophosphate, zinc di-(decyl) dithiophosphate, zinc di-(dodecyl) dithiophosphate, zinc di-(dodecylphenyl) dithiophosphate, zinc di-(heptylphenyl) dithiophosphate, or mixtures thereof.

Examples of a zinc dialkylphosphate include zinc di-(2-methylpropyl) phosphate, zinc di-(amyl) phosphate, zinc di-(1,3-dimethylbutyl) phosphate, zinc di-(heptyl) phosphate, zinc di-(octyl) phosphate, zinc di-(2-ethylhexyl) phosphate, zinc di-(nonyl) phosphate, zinc di-(decyl) phosphate, zinc di-(dodecyl) phosphate, zinc di-(dodecylphenyl) phosphate, zinc di-(heptylphenyl) phosphate, or mixtures thereof.

Examples of a non-ionic phosphorus compound with phosphorus atoms having an oxidation state of +3 include a phosphite ester, or mixtures thereof. A more detailed description of the non-ionic phosphorus compound include column 9, line 48 to column 11, line 8 of U.S. Pat. No. 6,103,673.

Methods of lubricating components of a farm tractor, off-highway vehicle or drivetrain are also disclosed. The method may comprise contacting the component with any of the lubricating compositions described above.

The azole-acrylic adduct as described above may be used in lubricating compositions to reduce corrosion in a component of a farm tractor, off-highway vehicle, or drivetrain. Methods reducing corrosion in a component of a farm tractor, off-highway vehicle or drivetrain are also disclosed. The methods may comprise contacting the component with the lubricating compositions comprising an azole-acrylic adduct as described above.

In one embodiment, the component is a drivetrain component comprising at least one of a transmission, manual transmission, gear, gearbox, axle gear, automatic transmission, a dual clutch transmission, or combinations thereof. In another embodiment, the transmission may be an automatic transmission or a dual clutch transmission (DCT). Additional exemplary automatic transmissions include, but are not limited to, continuously variable transmissions (CVT), infinitely variable transmissions (IVT), toroidal transmissions, continuously slipping torque converted clutches (CSTCC), and stepped automatic transmissions.

Alternatively, the transmission may be a manual transmission or gear. In yet another embodiment, the component may be a farm tractor or off-highway vehicle component comprising at least one of a wet-brake, a transmission, a hydraulic, a final drive, a power take-off system, or combinations thereof.

Oils of Lubricating Viscosity

The lubricating oil composition includes natural or synthetic oils of lubricating viscosity, oil derived from hydrocracking, hydrogenation, hydrofinishing, and unrefined, refined and re-refined oils and mixtures thereof.

Natural oils include animal oils, vegetable oils, mineral oils and mixtures thereof. Synthetic oils include hydrocarbon oils, silicon-based oils, and liquid esters of phosphorus-containing acids. Synthetic oils may be produced by Fischer-Tropsch gas-to-liquid synthetic procedure as well as other gas-to-liquid oils. In one embodiment the composition of the present invention is useful when employed in a gas-to-liquid oil. Often Fischer-Tropsch hydrocarbons or waxes may be hydroisomerised.

In one embodiment the base oil comprises a polyalphaolefin including a PAO-2, PAO-4, PAO-5, PAO-6, PAO-7 or PAO-8. The polyalphaolefin in one embodiment is prepared from dodecene and in another embodiment from decene.

In one embodiment the oil of lubricating viscosity is an ester such as an adipate.

In one embodiment the oil of lubricating viscosity is at least in-part a polymer (may also be referred to as a viscosity modifier) including hydrogenated copolymers of styrene-butadiene, ethylene-propylene copolymers, polyisobutenes, hydrogenated styrene-isoprene polymers, hydrogenated isoprene polymers, polymethacrylates, polyacrylates, polyalkyl styrenes, alkenyl aryl conjugated diene copolymers, polyolefins, esters of maleic anhydride-styrene copolymers, esters of maleic anhydride-olefin copolymers, and mixtures thereof. In different embodiments the polymer includes polyacrylates, polymethacrylates, and esters of maleic anhydride-styrene copolymers, polyisobutenes or mixtures thereof.

In one embodiment the lubricating composition contains an oil of lubricating viscosity containing mixtures of a viscosity modifier and an API Group III or IV base oil. In one embodiment the lubricating composition contains a synthetic oil of lubricating viscosity.

Oils of lubricating viscosity may also be defined as specified in the American Petroleum Institute (API) Base Oil Interchangeability Guidelines. In one embodiment the oil of lubricating viscosity comprises an API Group I, II, III, IV, V, VI base oil, or mixtures thereof, and in another embodiment API Group II, III, IV base oil or mixtures thereof. In another embodiment the oil of lubricating viscosity is a Group III or IV base oil and in another embodiment a Group IV base oil.

The amount of the oil of lubricating viscosity present is typically the balance remaining after subtracting from 100 wt % the sum of the amount of the compounds of the present invention, the thiadiazole, and other performance additives as described below.

In one embodiment the lubricating composition may be in the form of a concentrate and/or a fully formulated lubricant. If the lubricating composition (comprising the additives disclosed herein) is in the form of a concentrate which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight.

Other Performance Additives

The composition of the invention optionally further includes at least one other performance additive. The other performance additives include antiwear agents (including or in addition to the ones described above), extreme pressure agents, friction modifiers (including or in addition to the ones described above), metal deactivators, detergents, dispersants, viscosity modifiers, dispersant viscosity modifiers, antioxidants, corrosion inhibitors, foam inhibitors, demulsifiers, pour point depressants, seal swelling agents, and mixtures thereof.

In different embodiments, the total combined amount of the other performance additive compounds may be present at 0 wt % to 25 wt %, or 0.1 wt % to 15 wt %, or 0.5 wt % to 10 wt % of the lubricating composition. Although one or more of the other performance additives may be present, it is common for the other performance additives to be present in different amounts relative to each other.

Antioxidants include molybdenum compounds such as molybdenum dithiocarbamates, sulphurised olefins, hindered phenols, aminic compounds such as alkylated diphenylamines (typically di-nonyl diphenylamine, octyl diphenylamine, or di-octyl diphenylamine), or mixtures thereof.

Detergents include neutral or overbased detergents, Newtonian or non-Newtonian, basic salts of alkali, alkaline earth or transition metals with one or more of a phenate, a sulphurised phenate, a sulphonate, a carboxylic acid, a phosphorus acid, a mono- and/or a di-thiophosphoric acid, a saligenin, an alkyl salicylate, and a salixarate mixtures.

Dispersants include N-substituted long chain alkenyl succinimides, as well as Mannich condensation products as well as post-treated versions thereof. Post-treated dispersants include those by reaction with urea, thiourea, dimercaptothiadiazoles, carbon disulphide, aldehydes, ketones, carboxylic acids, hydrocarbon-substituted succinic anhydrides, nitriles, epoxides, boron compounds, and phosphorus compounds, mixtures.

Additional suitable dispersants are boron-containing compounds. In one embodiment the dispersant is a borated dispersant, typically a borated polyisobutylene succinimide. Typically the number average molecular weight of the polyisobutylene ranges from 450 to 5000, or 550 to 2500. The borated dispersant may also have friction performance.

In different embodiments, the dispersant may present at 0 wt % to 10 wt %, or 0.01 wt % to 10 wt %, or 0.1 wt % to 5 wt %, of the lubricating composition.

Viscosity modifiers include hydrogenated copolymers of styrene-butadiene, ethylene-propylene copolymers, polyisobutenes, hydrogenated styrene-isoprene polymers, hydrogenated isoprene polymers, polymethacrylates, polyacrylates, polyalkyl styrenes, hydrogenated alkenyl aryl conjugated diene copolymers, polyolefins, esters of maleic anhydride-styrene copolymers, esters of maleic anhydride-olefin copolymers, or mixtures thereof.

In one embodiment the viscosity modifier is other than olefin copolymers, typically ethylene-propylene copolymers. In one embodiment the viscosity modifier includes polyisobutenes, polymethacrylates, polyacrylates, esters of maleic anhydride-styrene copolymers, esters of maleic anhydride-olefin copolymers, or mixtures thereof. In one embodiment the viscosity modifier includes polymethacrylates.

In different embodiments, the viscosity modifier may be present at 0 wt % to 70 wt %, or 1 wt % to 65 wt %, or 5 wt % to 60 wt %, or greater than 12 wt % to 55 wt % of the lubricating composition. If viscosity modifiers with a low number average molecular weight (i.e., 20,000 or less) are employed, higher treatment rates are typically required. In some instances the treat rate may be sufficiently high that the viscosity modifier becomes a significant replacement for base oil (or the oil of lubricating viscosity). As such the viscosity modifiers may be viewed as a synthetic base stock, or as a component of the base oil.

Dispersant viscosity modifiers (often referred to as DVM) include functionalised polyolefins, for example, ethylene-propylene copolymers that have been functionalized with the reaction product of maleic anhydride and an amine, a polymethacrylate functionalised with an amine, or styrene-maleic anhydride copolymers reacted with an amine; these may also be used in the composition of the invention.

Corrosion inhibitors include octylamine octanoate, condensation products of dodecenyl succinic acid or anhydride and a fatty acid such as oleic acid with a polyamine, or a thiadiazole compound described above. Metal deactivators include derivatives of benzotriazoles (typically tolyltriazole), 1,2,4-triazoles, 2-alkyldithiobenzimidazoles, 2-alkyldithiobenzothiazoles, or benzimidazoles.

Foam inhibitors include copolymers of ethyl acrylate and 2-ethylhexylacrylate and optionally vinyl acetate. Demulsifiers include trialkyl phosphates, polyethylene glycols, polyethylene oxides, polypropylene oxides and (ethylene oxide-propylene oxide) polymers. Pour point depressants include esters of maleic anhydride-styrene, polymethacrylates, polyacrylates or polyacrylamides. Seal swell agents include Exxon Necton-37™ (FN 1380) and Exxon Mineral Seal Oil (FN 3200).

The lubricating composition may include an amine salt of a phosphorus acid ester. This material can serve as one or more of an extreme pressure agent and a wear preventing agent. The amine salt of a phosphorus acid ester may include phosphoric acid esters and salts thereof; dialkyldithiophosphoric acid esters and salts thereof; phosphites; and phosphorus-containing carboxylic esters, ethers, and amides; and mixtures thereof. The amine salt of the phosphorus acid ester may comprise any of a variety of chemical structures. A variety of structures are possible when the phosphorus acid ester compound contains one or more sulfur atoms, that is, when the phosphorus-containing acid is a thiophosphorus acid ester, including mono- or dithiophosphorus acid esters. A phosphorus acid ester may be prepared by reacting a phosphorus compound such as phosphorus pentoxide with an alcohol. Suitable alcohols include those containing up to 30 or to 24, or to 12 carbon atoms, including primary or secondary alcohols such as isopropyl, butyl, amyl, s-amyl, 2-ethylhexyl, hexyl, cyclohexyl, octyl, decyl and oleyl alcohols, as well as any of a variety of commercial alcohol mixtures having, e.g., 8 to 10, 12 to 18, or 18 to 28 carbon atoms. Polyols such as diols may also be used. The amines which may be suitable for use as the amine salt include primary amines, secondary amines, tertiary amines, and mixtures thereof, including amines with at least one hydrocarbyl group, or, in certain embodiments, two or three hydrocarbyl groups having, e.g., 2 to 30 or 8 to 26 or 10 to 20 or 13 to 19 carbon atoms. In one embodiment, amine salt of the phosphorus acid ester may comprise phosphorous that is present in an amount such that the lubricating composition has 200 to 1500, or 300 to 1300, 350 to 800, or 500 to 1000 ppm phosphorous based on a total weight of the lubricating composition.

In different embodiments, the lubricating composition may have a composition as described in Table 2. The weight percents (wt %) shown in Table 2 below are on an actives basis.

TABLE 2

| | Embodiments (wt %) | | |
|---|---|---|---|
| Additive | MTF Manual | DCT Dual-Clutch | Off-Highway |
| Azole-acrylic Adducts | 0.01 to 3 | 0.01 to 3 | 0.01 to 3 |
| Dispersant | 1 to 6 | 0.05 to 4 | 0 to 5 |
| Extreme Pressure Agent | 0 to 6 | 0 to 0.5 | 0 to 3 |
| Overbased Detergent | 0.01 to 2 | 0 to 1 | 0.5 to 6 |
| Friction Modifier | 0 to 5 | 0 to 5 | 0.1 to 1.5 |
| Antioxidant | 0 to 2 | 0 to 2 | 0 to 3 |
| Antiwear Agent | 0.01 to 3 | 0.5 to 3 | 0.5 to 3 |
| Viscosity Modifier | 0.1 to 70 | 0.1 to 15 | 1 to 60 |
| Any Other Performance Additive | 0 to 10 | 0 to 10 | 0 to 6 |
| Oil of Lubricating Viscosity | Balance to 100% | Balance to 100% | Balance to 100% |

The following examples provide illustrations of the invention. These examples are non-exhaustive and are not intended to limit the scope of the invention.

EXAMPLES—SYNTHESIS OF AZOLE-ACRYLIC ADDUCTS

The following examples show the synthesis of various Michael reaction products, including the azole-acrylic adducts described herein.

Example A-1—Reaction Product of tolyltriazole and 2-ethylhexyl acrylate

For Example A-1, tolyltriazole TTZL (1 mole equivalant), 2-ethylhexyl acrylate (1 mol. eq.), triethyl amine (0.33 mol. eq.) and acetonitrile are added to a 4-necked, 1-L round bottom flask. The mixture is stirred vigorously to facilitate dissolution of the TTZL. The reaction is held at 75° C. until the reaction is complete. The reaction mixture comprising the azole-acrylic adduct is obtained upon rotary evaporation and filtration over calcined diatomaceous earth.

Example A-2—Reaction Product of benzotriazole and 2-ethylhexyl acrylate

For Example A-2, benzotriazole and 2-ethylhexyl acrylate are reacted under the same reaction conditions as Example A-1.

Example A-3—Reaction Product of imidazole and 2-ethylhexyl acrylate

For Example A-3, imidazole and 2-ethylhexyl acrylate are reacted under the same reaction conditions as Example A-1.

Example A-4—Reaction Product of 1, 2, 4-triazole and 2-ethylhexyl acrylate

For Example A-4, 1, 2, 4-triazole and 2-ethylhexyl acrylate are reacted under the same reaction conditions as Example A-1.

Example A-5—Reaction Product of benzimidazole and 2-ethylhexyl acrylate

For Example A-5, benzimidazole and 2-ethylhexyl acrylate are reacted under the same reaction conditions as Example A-1.

Example A-6—Reaction Product of pyrazole and 2-ethylhexyl acrylate

For Example A-6, pyrazole and 2-ethylhexyl acrylate are reacted under the same reaction conditions as Example A-1.

Example A-7—Reaction Product tolyltriazole and butyl acrylate

For Example A-7, tolyltriazole and butyl acrylate are reacted under the same reaction conditions as Example A-1.

Example A-8—Reaction Product of tolyltriazole and ethyl acrylate

For Example A-8, tolyltriazole and ethyl acrylate are reacted under the same reaction conditions as Example A-1.

Examples—Performance of Azole-Acrylic Adducts

The performance of the azole-acrylic adducts was tested using a copper corrosion test, whereby a copper coupon is immersed in test fluid. The test fluid is heated to 150° C. while air is continuously bubbled through it for one week. After one week, the test fluid is analyzed for copper content using inductively coupled plasma mass spectrometry (ICP). The copper coupons were also visually assessed.

Manual Transmission Fluids (MTFs)

A series of tests using a manual transmission fluid (MTF) as the test fluid are performed. For the MTF, lubricating compositions are prepared using a 4 cSt synthetic Group IV base oil of lubricating viscosity and the azole-acrylic adducts described above as well as conventional additives including a boron-containing compound (borated succinimide dispersant), friction modifiers (combination of carboxylic ester and ethoxylated amine), antioxidants/extreme pressure agents (combination of an aminic compound and a sulfurized olefin), an overbased detergent (sodium sulphonate), phosphoric acid esters/amine salt, antiwear agents (combination of alkenyl and alkyl phosphites), and a foam inhibitor. All of the lubricants are prepared from a common formulation as follows in Table 3.

The additives of the disclosed technology are added to the MTF baseline formulation below.

TABLE 3

MTF Lubricating Oil Composition Base Formulation[1]

| Group IV Base Oil | Baseline (BL1) Balance to 100% |
|---|---|
| Boron-Containing Compound | 1.69 |
| Friction Modifier | 0.40 |
| Antioxidant | 0.60 |
| Extreme Pressure/Antiwear Agent | 0.30 |
| Overbased Detergent | 0.58 |
| Foam Inhibitor | 0.01 |
| Antiwear Agent | 0.60 |

[1]All concentrations are on an oil free (i.e. active basis)

The additives of the disclosed technology are added to the MTF baseline formulation above and the copper tests described above are performed. Upon the completion of the tests, the concentration in the oil is measured. The results are summarized in Table 4.

TABLE 4

Lubricating Oil Composition Formulations

| | thiadiazole | A-1 | A-8 | Cu (ppm) |
|---|---|---|---|---|
| Comp 1 | 0.30 | | | 336 |
| EX1 | 0.25 | 0.05 | | 304 |
| EX2 | 0.20 | 0.10 | | 31 |
| EX3 | 0.10 | 0.20 | | 14 |
| EX4 | 0.30 | 0.30 | | 49 |
| EX5 | 0.25 | | 0.05 | 268 |
| EX6 | 0.20 | | 0.10 | 34 |
| EX7 | 0.10 | | 0.20 | 25 |
| EX8 | 0.30 | | 0.30 | 92 |

Dual Clutch Transmission Fluids (DCTs)

A series of tests using a dual clutch automatic transmission fluid (DCT) as the test fluid are performed. For the DCT, a mixture of 3 cSt and 4 cSt Group III base oils of lubricating viscosity was prepared containing azole-acrylic adducts described above as well as conventional additives including a boron-containing compound (borated succinimide dispersant), friction modifiers (combination of a borate ester, an ethoxylated amine, phosphoric acid, and a reaction product of isostearic acid and tetraethylenepentamine), an antioxidant (aminic compound), an overbased detergent (calcium sulphonate), antiwear agents (combination of alkenyl and alkyl phosphites), a seal swell agent, a pour point depressant, and a foam inhibitor. All of the lubricants are prepared from a common formulation as follows in Table 5.

The additives of the disclosed technology are added to the DCT baseline formulation below.

TABLE 5

DCT Lubricating Oil Composition Base Formulation[2]

| Group III Base Oil (and diluent) | Baseline (BL2) Balance to 100% |
|---|---|
| Boron-Containing Compound | 3.00 |
| Friction Modifiers | 0.59 |
| Antioxidant | 0.60 |
| Overbased Detergent | 0.12 |
| Seal Swell Agent | 0.35 |
| Pour Point Depressant | 0.10 |
| Foam Inhibitor | 0.02 |
| Antiwear Agent | 0.22 |

[2]All concentrations are on an oil free (i.e. active basis)

The additives of the disclosed technology are added to the DCT baseline formulation above and the copper tests described above are performed. Upon the completion of the tests, the concentration in the oil is measured. The results are summarized in Table 6.

TABLE 6

Lubricating Oil Composition Formulations

| | thiadiazole | A-1 | A-8 | Cu (ppm) |
|---|---|---|---|---|
| Comp 2 | 0.50 | | | 180 |
| Comp 3 | 0.00 | 0.50 | | 497 |
| EX9 | 0.20 | | 0.30 | 31 |
| EX10 | 0.20 | 0.30 | | 30 |
| EX11 | 0.00 | | 0.50 | 512 |

The copper test results show that adding the azole-acrylate adducts to lubricant compositions can reduce the copper concentration in the fluid, suggesting copper corrosion is reduced. The tests also show there may be a synergistic effect then using the azole-acrylate adducts with a thiadiazole.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

While certain representative embodiments and details have been shown for the purpose of illustrating the subject invention, it will be apparent to those skilled in this art that various changes and modifications can be made therein without departing from the scope of the subject invention. In this regard, the scope of the invention is to be limited only by the following claims.

What is claimed is:

1. A lubricating composition comprising:

a. an oil of a lubricating viscosity;

b. 0.1 to 0.3 wt % of a thiadiazole comprises a hydrocarbyl substituted 2,5-dimercapto-1,3,4-thiadiazole; and c. 0.1 to 0.3 wt % of an azole-acrylic adduct represented by formula (VI):

(VI)

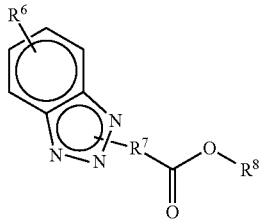

wherein $R^6$ is $CH_3$; $R^7$ is attached to a nitrogen atom and is a linear $C_2$ hydrocarbyl group; and $R^8$ is a $C_{24}$-$C_8$ hydrocarbyl group and is linear, branched, homocyclic, heterocyclic, or a combination thereof; and wherein the aggregate amount of the thiadiazole and the azole-acrylic adduct is at least 0.3 wt %, based on a total weight of the lubricating composition.

2. The lubricating composition of claim 1, wherein said acrylic comprises at least one of octadecyl acrylate, hexadecyl acrylate, tridecyl acrylate, dodecyl acrylate, decyl acrylate, 2-propylheptyl acrylate, 2-ethylhexyl acrylate, octyl acrylate, hexyl acrylate, butyl acrylate, ethyl acrylate, methyl acrylate, or combinations thereof.

3. The lubricating composition of claim 1, wherein said thiadiazole comprises 1,3,4-thiadiazole, 2,5-bis(tert-nonyldithio), 2-(heptylhydroxyphenylmethylthio)-5-mercapto-[1,3,4]-thiadiazole, or mixtures thereof.

4. The lubricating composition of claim 1, further comprising at least one friction modifier.

5. The lubricating composition of claim 1 further comprising a phosphorus-containing antiwear agent present in an amount such that said lubricating composition has about 300 ppm phosphorus based on a total weight of said lubricating composition.

6. A method of lubricating a component of a farm tractor, off-highway vehicle or drivetrain, said method comprising contacting said component with the lubricating composition of claim 1.

7. A method of reducing corrosion in a component of a farm tractor, off-highway vehicle or drivetrain comprising contacting the component with the lubricating composition of claim 1.

8. The method of claim 7 wherein the component is a drivetrain component comprising at least one of a transmission, manual transmission, gear, gearbox, axle gear, automatic transmission, a dual clutch transmission, or combinations thereof.

9. The method of claim 7 wherein the component is a farm tractor or off-highway vehicle component comprising at least one of a wet-brake, a transmission, a hydraulic, a final drive, a power take-off system, or combinations thereof.

* * * * *